US012157162B2

(12) United States Patent
Kato et al.

(10) Patent No.: US 12,157,162 B2
(45) Date of Patent: Dec. 3, 2024

(54) ADDITIVE FOR FORMING SAND MOLD, SAND COMPOSITION FOR FORMING SAND MOLD, METHOD FOR PRODUCING SAND MOLD, AND SAND MOLD

(71) Applicants: TAKEMOTO YUSHI KABUSHIKI KAISHA, Gamagori (JP); SINTOKOGIO, LTD., Nagoya (JP)

(72) Inventors: Yusuke Kato, Toyokawa (JP); Tomohiro Aoki, Toyokawa (JP); Shumma Sato, Gamagori (JP)

(73) Assignees: TAKEMOTO YUSHI KABUSHIKI KAISHA, Gamagori (JP); SINTOKOGIO, LTD., Nagoya (JP)

( * ) Notice: Subject to any disclaimer, the term of this patent is extended or adjusted under 35 U.S.C. 154(b) by 330 days.

(21) Appl. No.: 17/761,478

(22) PCT Filed: Jun. 8, 2020

(86) PCT No.: PCT/JP2020/022580
§ 371 (c)(1),
(2) Date: Mar. 17, 2022

(87) PCT Pub. No.: WO2021/059605
PCT Pub. Date: Apr. 1, 2021

(65) Prior Publication Data

US 2022/0371080 A1 Nov. 24, 2022

(30) Foreign Application Priority Data

Sep. 25, 2019 (JP) ..... 2019-173985

(51) Int. Cl.
*B22C 1/18* (2006.01)
*B22C 1/02* (2006.01)
*B22C 9/02* (2006.01)

(52) U.S. Cl.
CPC ..... *B22C 1/02* (2013.01); *B22C 1/18* (2013.01); *B22C 1/188* (2013.01); *B22C 9/02* (2013.01)

(58) Field of Classification Search
CPC .. B22C 1/02; B22C 1/18; B22C 1/188; B22C 9/02
See application file for complete search history.

(56) References Cited

U.S. PATENT DOCUMENTS

| | | | | |
|---|---|---|---|---|
| 3,857,712 | A * | 12/1974 | Chevriot | B22C 1/188 106/38.3 |
| 9,314,837 | B2 | 4/2016 | Mitsutake et al. | |
| 10,259,035 | B2 | 4/2019 | Deters et al. | |
| 2014/0284015 | A1 | 9/2014 | Mitsutake et al. | |
| 2015/0306658 | A1 | 10/2015 | Deters et al. | |

FOREIGN PATENT DOCUMENTS

| | | | | |
|---|---|---|---|---|
| CH | 470 922 | A | 4/1969 | |
| EP | 3646965 | A1 * | 5/2020 | B22C 1/20 |
| JP | 47-36133 | B1 | 9/1972 | |
| JP | 2013-111602 | A | 6/2013 | |
| JP | 2016-500337 | A | 1/2016 | |
| SE | 310 761 | B | 5/1969 | |
| WO | WO-2017077372 | A1 * | 5/2017 | B22C 1/02 |

OTHER PUBLICATIONS

Combined Chinese Office Action and Search Report issued Oct. 28, 2023 in Chinese Patent Application No. 202080057324.2 (with unedited computer-generated English translation), 14 pages.
International Search Report mailed on Aug. 4, 2020 in PCT/JP2020/022580 filed on Jun. 8, 2020, 2 pages).
Notice of Reasons for Refusal issued Oct. 22, 2020 in corresponding Japanese Application No. 2019-173985, 7 pages (with English Translation ).

* cited by examiner

*Primary Examiner* — Kevin E Yoon
(74) *Attorney, Agent, or Firm* — Oblon, McClelland, Maier & Neustadt, L.L.P.

(57) ABSTRACT

The additive composition of the present invention is one blended in a sand composition which is subjected to foaming to mold a sand mold, and includes (A) an alkylsulfonate metal salt having an alkyl group with 9 to 22 carbon atoms. The additive composition may further include at least one component selected from a group consisting of (B) an alkylsulfate metal salt, (C) a polyoxyalkylene alkyl ether sulfate metal salt, and (D) an alkylbenzene sulfonate metal salt.

11 Claims, No Drawings

ADDITIVE FOR FORMING SAND MOLD, SAND COMPOSITION FOR FORMING SAND MOLD, METHOD FOR PRODUCING SAND MOLD, AND SAND MOLD

TECHNICAL FIELD

The present invention relates to an additive composition blended in a sand composition which is subjected to foaming to mold a sand mold, a sand composition for molding a sand mold including the additive composition, a method for producing a sand mold, and a sand mold.

BACKGROUND ART

There is a production method using a collapsible sand mold (core) to obtain a cast product having a hollow portion (see, for example, Patent Literature 1). At the time of molding the sand mold, a sand mold forming apparatus including: a permanent mold having a cavity for solidifying foamed sand to mold a sand mold; and a filling device that fills the cavity with the foamed sand is used. At this time, foamed sand obtained by stirring and foaming a mixture containing sand particles and a binder is used as the foamed sand. Such foamed sand is usually formed by attachment (adsorption) of a foam containing a binder that binds sand particles to each other, water, and a surfactant on surfaces of the sand particles.

Patent Literature 1 discloses a sand mold forming method for molding a sand mold using water glass as a binder, and foamed sand obtained by kneading sand particles serving as an aggregate, water glass serving as a binder, water, and a surfactant and foaming the mixture is used.

PRIOR ART LITERATURE

Patent Literature

Patent Literature 1: JP-A 2013-111602

SUMMARY OF INVENTION

Technical Problems

A surfactant is indispensable for preparing a foamed sand for use in molding a sand mold, but, depending on type, may provide an insufficient filling performance into a permanent mold and insufficient productivity of the sand mold.

An object to be solved by the present invention is to provide an additive composition for molding a sand mold that is used in combination with sand particles (sand), and leads to a sand composition which is excellent in filling performance into a permanent mold during sand mold molding, and realizes shortening of a production time for a sand mold, a sand composition for molding a sand mold including the additive composition for molding a sand mold, a method for producing a sand mold, and a sand mold.

Solutions to Problems

As a result of intensive studies, the present inventors have found that an additive composition for molding a sand mold containing an alkylsulfonate metal salt having an alkyl group with 9 to 22 carbon atoms and a sand composition for molding a sand mold including such an additive composition solve the above problems.

The present invention is as follows.

The additive composition for molding a sand mold of the present invention is characterized by including an alkylsulfonate metal salt (hereinafter, also referred to as "component (A)") having an alkyl group with 9 to 22 carbon atoms.

The additive composition for molding a sand mold of the present invention may further include at least one component selected from a group consisting of: (B) an alkylsulfate metal salt (hereinafter, also referred to as "component (B)"), (C) a polyoxyalkylene alkyl ether sulfate metal salt (hereinafter, also referred to as "component (C)"), and (D) a alkylbenzene sulfonate metal salt (hereinafter, also referred to as "component (D)"). Among them, it is preferable that the additive composition contains at least one of the component (B) and the component (C).

The component (B) preferably contains an alkylsulfate metal salt having an alkyl group with 8 to 18 carbon atoms.

The component (C) preferably contains a polyoxyalkylene alkyl ether sulfate metal salt having an alkyl group with 10 to 16 carbon atoms.

In a case where the additive composition for molding a sand mold of the present invention includes the component (A), the component (B), the component (C), and the component (D), a content ratio of the component (A) is preferably in a range from 80% to 96% by mass based on 100% by mass of a total of these components.

In a case where the additive composition for molding a sand mold of the present invention includes the component (A), the component (B), and the component (C), content ratios of the component (A), the component (B), and the component (C) are preferably respectively 80% to 96% by mass, 2% to 10% by mass, and 2% to 10% by mass, based on 100% by mass of a total of these components.

The sand composition for molding a sand mold of the present invention is characterized by including the additive composition for molding a sand mold, and a sand.

The production method of a sand mold of the present invention is characterized in that the sand composition for molding a sand mold is subjected to molding.

The production method of a sand mold of the present invention preferably includes the steps of: stirring the composition for molding a sand mold to foam the composition for molding a sand mold; filling a space for forming a mold with the obtained foamed composition; and solidifying a filling material in the space for forming a mold.

The production method of a sand mold of the present invention preferably includes the steps of: foaming the additive composition for molding a sand mold to prepare a foamy material, and stirring the foamy material and the sand to foam the sand composition for molding a sand mold; filling a space for forming a mold with the obtained foamed composition; and solidifying a filling material in the space for forming a mold.

The sand mold of the present invention characterized by containing the additive composition for molding a sand mold, and a sand.

Advantageous Effects of Invention

The additive composition for molding a sand mold of the present invention is suitable as an additive composition which leads to a composition for molding a sand mold excellent in productivity of a sand mold.

The sand composition for molding a sand mold including the additive composition for molding a sand mold according to the present invention, when foamed and used, is excellent in filling performance into a permanent mold at the time of sand mold molding and can shorten a production time for a sand mold, and thus has an effect of being excellent in productivity of a sand mold.

The method for producing a sand mold of the present invention has effects of being excellent in filling performance of the composition for molding a sand mold into a permanent mold at the time of sand mold molding and shortening the production time for a sand mold.

DESCRIPTION OF EMBODIMENT

The additive composition for molding a sand mold of the present invention (hereinafter, referred to as "additive composition of the present invention") is an additive composition which is blended in a sand composition to be foamed and used in molding a sand mold (sand composition for molding a sand mold), and is an additive composition containing the component (A).

The component (A) is an alkylsulfonate metal salt having an alkyl group with 9 to 22 carbon atoms. The alkyl group is preferably a hydrocarbon group derived from an aliphatic hydrocarbon.

Examples of an alkylsulfonic acid with 9 to 22 carbon atoms include nonylsulfonic acid, decylsulfonic acid, undecylsulfonic acid, dodecylsulfonic acid, tridecylsulfonic acid, tetradecylsulfonic acid, pentadecylsulfonic acid, hexadecylsulfonic acid, heptadecylsulfonic acid, octadecylsulfonic acid, nonadecylsulfonic acid, eicosylsulfonic acid, heneicosylsulfonic acid, and docosylsulfonic acid. The metal salt thereof may be either a monovalent metal salt or a polyvalent metal salt.

The component (A) is preferably a monovalent metal salt, and more preferably a water-soluble alkali metal salt such as sodium salt, potassium salt, and lithium salt, from a viewpoint of the foaming property of the sand composition for molding a sand mold.

In general, examples of the alkylsulfonate metal salt includes a primary alkylsulfonate metal salt, a secondary alkylsulfonate metal salt, and the like. It is preferably a primary alkylsulfonate metal salt.

Specific examples of the component (A) include sodium nonylsulfonate, sodium decylsulfonate, sodium undecylsulfonate, sodium dodecylsulfonate, lithium dodecylsulfonate, sodium tridecylsulfonate, lithium tridecylsulfonate, sodium tetradecylsulfonate, lithium tetradecylsulfonate, sodium pentadecylsulfonate, lithium pentadecylsulfonate, sodium hexadecylsulfonate, lithium hexadecylsulfonate, sodium heptadecylsulfonate, lithium heptadecylsulfonate, sodium octadecylsulfonate, lithium octadecylsulfonate, sodium nonadecylsulfonate, sodium eicosylsulfonate, potassium eicosylsulfonate, sodium heneicosylsulfonate, sodium docosylsulfonate, potassium docosylsulfonate, and the like. The component (A) is particularly preferably an alkylsulfonate alkali metal salt having an alkyl group with 9 to 18 carbon atoms since the effects of the present invention are more remarkable.

The component (A) may be contained singly or in combination of two or more types thereof in the additive composition of the present invention. When the plurality of components (A) are used, the components (A) preferably contains at least an alkylsulfonate metal salt having an alkyl group with 9 to 18 carbon atoms.

The additive composition of the present invention may include other components. As a component having properties similar to those of the component (A) or a component that improves the effects of the present invention by being used in combination with the component (A), an alkylsulfate metal salt (component (B)), a polyoxyalkylene alkyl ether sulfate metal salt (component (C)), and a alkylbenzene sulfonate metal salt (component (D)) are particularly preferably used.

When the additive composition of the present invention further contains at least one selected from the group consisting of the components (B), (C) and (D), a content ratio of the component (A) is preferably in a range from 80% to 96% by mass, and more preferably from 92% to 96% by mass, based on 100% by mass of a total of the components (A), (B), (C) and (D).

The component (B) is an alkylsulfate metal salt and is represented by $R^1—O—SO_3M^1$ ($R^1$ is an alkyl group, and $M^1$ is a metal atom). In this general formula, $R^1$ is preferably a hydrocarbon group derived from an aliphatic hydrocarbon having 8 or more carbon atoms. $M^1$ may be either a monovalent metal atom or a polyvalent metal atom, but is preferably an alkali metal atom, more preferably Li, Na, and K, and particularly Na.

In general, examples of the alkylsulfate metal salt include a primary alkylsulfate metal salt, a secondary alkylsulfate metal salt, and the like. It is preferably a primary alkylsulfate metal salt.

Specific examples of the component (B) include sodium octyl sulfate, sodium nonyl sulfate, sodium decyl sulfate, potassium decyl sulfate, sodium undecyl sulfate, sodium dodecyl sulfate, lithium dodecyl sulfate, sodium tridecyl sulfate, sodium tetradecyl sulfate, sodium pentadecyl sulfate, sodium hexadecyl sulfate, sodium heptadecyl sulfate, sodium octadecyl sulfate, and the like. The component (B) is preferably an alkylsulfate alkali metal salt having an alkyl group $R^1$ having 8 to 18 carbon atoms, and more preferably an alkylsulfate alkali metal salt having an alkyl group $R^1$ having 8 to 14 carbon atoms, since the effects of the present invention can be further improved.

The component (B) may be contained singly or in combination of two or more types thereof in the additive composition of the present invention.

The component (C) is a polyoxyalkylene alkyl ether sulfate metal salt, and is represented by $R^2—O—(R^3—O)_n—SO_3M^2$ ($R^2$ is an alkyl group, $R^3$ is an alkylene group, $M^2$ is a metal atom, and n is 2 to 5). In this general formula, $R^2$ is a linear or branched hydrocarbon group, and preferably a hydrocarbon group derived from an aliphatic hydrocarbon, having 10 or more carbon atoms. $R^3$ is preferably an alkylene group having 2 or more carbon atoms, and more preferably an alkylene group having 2 to 4 carbon atoms (ethylene group, propylene group or butylene group). $M^2$ may be either a monovalent metal atom or a polyvalent metal atom. It is preferably an alkali metal atom, more preferably Li, Na, and K, and particularly preferably Na. A plurality of $R^3$s may be one kind or two or more kinds.

The polyoxyalkylene alkyl ether sulfate metal salt is preferably a polyoxyalkylene alkyl ether sulfate metal salt in which $R^2$ in the general formula is a primary alkyl group.

Examples of the component (C) include sodium polyoxyethylene decyl ether sulfate, potassium polyoxypropylene decyl ether sulfate, sodium polyoxyethylene undecyl ether sulfate, sodium polyoxyethylene dodecyl ether sulfate, lithium polyoxyethylene dodecyl ether sulfate, sodium polyoxyethylene tridecyl ether sulfate, sodium polyoxyethylene tetradecyl ether sulfate, sodium polyoxyethylene pentadecyl ether sulfate, sodium polyoxyethylene hexadecyl ether sulfate, and the like. The component (C) is preferably a polyoxyalkylene alkyl ether sulfate alkali metal salt having an alkyl group $R^2$ having 10 to 16 carbon atoms, and more preferably a polyoxyalkylene alkyl ether sulfate alkali metal salt having an alkyl group $R^2$ having 10 to 14 carbon atoms, since the effects of the present invention can be further improved. Examples of an alkylene oxide added include ethylene oxide, propylene oxide, 1,2-butylene oxide, 1,4-butylene oxide, and the like. Among them, ethylene oxide is preferable. The number of moles of ethylene oxide added is preferably in a range from 2 to 5 mol, and more preferably from 3 to 4 mol.

The component (C) may be contained singly or in combination of two or more types thereof in the additive composition of the present invention.

The component (D) is an alkylbenzene sulfonate metal salt, and is represented by $R^4$—O—$SO_3M^3$ ($R^4$ is an alkylphenyl group, and $M^3$ is a metal atom). In this general formula, $R^4$ is preferably a hydrocarbon group derived from a hydrocarbon including an aromatic ring, having 7 or more carbon atoms. $M^3$ may be either a monovalent metal atom or a polyvalent metal atom. It is preferably an alkali metal atom, more preferably Li, Na, and K, and particularly Na.

The alkylbenzene sulfonate metal salt may be either a linear alkylbenzene sulfonate metal salt or a branched alkylbenzene sulfonate metal salt.

Examples of the component (D) include sodium decylbenzene sulfonate, potassium decylbenzene sulfonate, sodium undecylbenzene sulfonate, sodium dodecylbenzene sulfonate, sodium tridecylbenzene sulfonate, sodium tetradecylbenzene sulfonate, sodium pentadecylbenzene sulfonate, sodium hexadecylbenzene sulfonate, and the like. The component (D) is preferably an alkylbenzene sulfonate metal salt having an alkylphenyl group $R^4$ having 16 to 22 carbon atoms, since the effects of the present invention can be further improved.

The component (D) may be contained singly or in combination of two or more types thereof in the additive composition of the present invention.

When the additive composition of the present invention contains a component composed of the component (B), (C) or (D), combinations of the components are exemplified below:

(1) a combination of the components (A) and (B);
(2) a combination of the components (A), (B) and (C);
(3) a combination of the components (A), (B) and (D);
(4) a combination of the components (A), (B), (C) and (D);
(5) a combination of the components (A) and (C);
(6) a combination of the components (A), (C) and (D); and
(7) a combination of the components (A) and (D).

Among them, the combinations (1), (2) and (5) are preferable, and the combination (2) is particularly preferable.

When the additive composition of the present invention contains the component (A) and one selected from the components (B), (C) and (D), that is, in cases of the above combinations (1), (5) and (7), a content ratio of the component (A) is preferably in a range from 80% to 96% by mass, and more preferably from 92% to 96% by mass, based on 100% by mass of a total of the component (A) and the one selected from the components (B), (C) and (D).

When the additive composition of the present invention contains the component (A) and two selected from the components (B), (C), and (D), that is, in cases of the above combinations (2), (3), and (6), a content ratio of the component (A) is preferably in a range from 80% to 96% by mass, and more preferably from 92% to 96% by mass, based on 100% by mass of a total of the component (A) and the two selected from the components (B), (C), and (D).

Particularly, in the above combination (2), content ratios of the components (A), (B), and (C) are respectively preferably 80% to 96% by mass, 2% to 10% by mass, and 2% to 10% by mass, and more preferably 92% to 96% by mass, 2% to 4% by mass, and 2% to 4% by mass, based on 100% by mass of a total of the components (A), (B), and (C), since a sand composition that effectively shortens the production time for a sand mold is obtained.

The additive composition of the present invention may further contain other components except sand depending on the purpose, intended use, and the like.

Examples of the other components that can be contained in the additive composition of the present invention include a liquid medium, a foaming agent, a binder, and the like.

The liquid medium is preferably water, and may also contain an organic solvent as necessary.

When the additive composition of the present invention contains water, the water dissolves the components (A), (B), (C), and (D), and thus the additive composition is easy to handle as an aqueous solution. When the additive composition of the present invention contains water and a water-soluble binder, the additive composition is similarly easy to handle.

The additive composition of the present invention can sufficiently foam the obtained sand composition only by the component (A) or by a combination of the component (A) and at least one selected from the group consisting of the components (B), (C) and (D). The additive composition of the present invention may additionally contain a foaming agent. Examples of the foaming agent include surfactants other than the components (A), (B), (C), and (D) (e.g., alkylsulfonate metal salts other than the component (A)); saponins, starches, or derivatives thereof; other saccharides such as cellulose, fructose, acarbose, raffinose, maltotriose, maltose, sucralose, trehalose, glucose, fructose, and oligosaccharide; and the like.

As described above, the additive composition of the present invention may contain a binder. This binder is preferably a component that dissolves in a liquid medium (usually, water). Example thereof includes an alkali silicate such as lithium silicate, sodium silicate, and potassium silicate; ammonium silicate, an orthophosphate, a pyrophosphate, a trimetaphosphate, a polymetaphosphate, a colloidal silica, a colloidal alumina, an alkyl silicate, and the like. Among these, an alkali silicate is preferable.

The alkali silicate is preferably a sodium silicate (water glass). A molar ratio (molecular ratio of $SiO_2$ to $Na_2O$) in the sodium silicate is preferably 1.2 or more and 3.8 or less, and preferably 2.0 or more and 3.3 or less. When the molar ratio is in the above range, the sodium silicate is not deteriorated when the additive composition containing an alkali silicate is stored at a low temperature for a long period of time, being preferable.

When the additive composition of the present invention contains a binder, a content ratio thereof is as follows.

When the additive composition of the present invention does not contain any of the components (B), (C) or (D), a content ratio of the binder is preferably in a range from 20 to 5,000 parts by mass, and more preferably from 50 to 1,500 parts by mass, based on 100 parts by mass of a content of the component (A).

When the additive composition of the present invention contains the component (A) and at least one selected from the group consisting of the components (B), (C) and (D), the content ratio of the binder is preferably in a range from 20 to 5,000 parts by mass, and more preferably from 50 to 1,500 parts by mass, based on 100 parts by mass of a total content of these components.

Next, a sand composition for molding a sand mold of the present invention (hereinafter, also referred to as "sand composition of the present invention") will be described.

The sand composition of the present invention is characterized by including the additive composition of the present invention and a sand.

The sand means sand particles. A constituent material thereof is not particularly limited, and conventionally known materials can be used. Examples of the constituent material include silica sand, alumina sand, olivine sand, chromite sand, zircon sand, mullite sand, an artificial sand, and the like. The constituent material for sand contained in the sand composition of the present invention may be only one kind or two or more kinds. Among them, when an artificial sand is used, even if an amount of the binder added is reduced, sufficient strength may be imparted to the obtained sand mold.

A grain size index of the sand (in accordance with JIS Z2601-1993) is preferably JIS; 631 (AFS; 300) or less and JIS; 5 (AFS; 3) or more, and more preferably JIS; 355 (AFS; 200) or less and JIS; 31 (AFS; 20) or more. When the grain size index is in the above range, the fluidity of the sand composition is excellent, and the filling performance of the sand composition into a permanent mold when a sand mold is formed is improved. In addition, air permeability of the obtained sand mold is favorable.

A shape of the sand is not particularly limited, and may be any shape such as a round shape, a rounded corner shape, a polygonal shape, and a pointed plate-shaped shape. A round shape is particularly preferable since the fluidity of the sand composition is excellent, the filling performance of the sand composition into a permanent mold when the sand mold is formed is improved, and the air permeability of the obtained sand mold is favorable.

The sand composition of the present invention may contain conventionally known components such as a catalyst and an oxidation accelerator.

The sand composition of the present invention is preferably a composition containing the component (A), a binder, and sand.

In the sand composition of the present invention, a content ratio of the component (A), which is an essential component of the additive composition, to the sand is preferably in a range from 0.005 to 2.0 parts by mass, and more preferably from 0.005 to 1.0 part by mass, based on 100 parts by mass of the sand.

When the sand composition of the present invention is obtained using an additive composition containing the component (A) and at least one selected from the group consisting of the components (B), (C) and (D), a content ratio of a total amount of the components (A), (B), (C) and (D) to the sand is preferably in a range from 0.005 to 2.0 parts by mass, and more preferably from 0.005 to 1.0 part by mass, based on 100 parts by mass of the sand.

In the sand composition of the present invention, content ratios of the binder and the sand can be set depending on types of the binder, and types and properties of the sand. In the sand composition of the present invention, the binder and the sand are blended such that the content ratio of the binder is preferably in a range from 0.1 to 20 parts by mass, and more preferably from 0.1 to 10 parts by mass, based on 100 parts by mass of the sand.

The sand composition of the present invention is preferably used as a raw material for a production of a sand mold.

The production method of a sand mold in the present invention a method that is characterized by molding the sand composition of the present invention. A preferred production method is a method using a foamed sand composition (hereinafter, referred to as "foamed composition").

The foamed composition can be prepared by the following methods.

(i) Method of mixing the additive composition of the present invention containing the component (A) but not containing a binder or a liquid medium; a binder; a liquid medium, and a sand, and then foaming the mixture (ii) Method of mixing the additive composition of the present invention containing the component (A) and a liquid medium but not containing a binder; a binder; and a sand, and then foaming the mixture (iii) Method of mixing the additive composition of the present invention containing the component (A) and a binder but not containing a liquid medium; a liquid medium; and a sand, and then foaming the mixture (iv) Method of mixing a sand and the additive composition of the present invention containing the component (A), a binder, and a liquid medium, and then foaming the mixture The foamed composition can also be produced by the following methods.

(v) Method of foaming, in advance, the additive composition of the present invention containing the component (A) but not containing a binder or a liquid medium, mixing the produced foamy material, a binder, a liquid medium, and a sand, and then foaming the mixture (vi) Method of foaming, in advance, the additive composition of the present invention containing the component (A) and a liquid medium but not containing a binder, mixing the produced foamy material, a binder, and a sand, and then foaming the mixture (vii) Method of foaming, in advance, the additive composition of the present invention containing the component (A) and a binder but not containing a liquid medium, mixing the produced foamy material, a liquid medium, and a sand, and then foaming the mixture (viii) Method of foaming, in advance, the additive composition of the present invention containing the component (A), a binder, and a liquid medium, mixing the produced foamy material and a sand, and then foaming the mixture In the methods (v) to (viii), examples of a method of mixing the additive composition of the present invention and then foaming the mixture to produce the foamy material include a method of mixing the additive composition and the binder in a porous body having a plurality of pores formed therein and passing the mixture along with air.

In the methods (i) to (viii), a conventionally known mixing device or kneading device can be used as a device for mixing and stirring to foam the sand composition. As the mixing device or kneading device, for example, "Tabletop Mixer" manufactured by AICOHSHA MFG. CO., LTD., "Intensive Mixer" manufactured by Nippon Eirich Co., Ltd., "Simpson Mix Muller" manufactured by SINTOKOGIO, LTD., and the like may be used.

In the present invention, a viscosity of the foamed composition suitable for molding a sand mold is preferably in a range from 0.5 to 10 Pa·s, and more preferably from 0.5 to 8 Pa·s. A method for measuring the viscosity is described in "EXAMPLES" below.

In the molding step using the sand composition of the present invention, it is preferable to fill a space of a permanent mold (heated mold) for forming a mold with the foamed composition and solidify the foamed composition.

The method for molding a sand mold using the foamed composition is not particularly limited, and may be either a molding method using a molding machine or a molding method by manual molding. Examples of the molding machine used in the former method include a jolt molding machine, a squeeze molding machine, a jolt squeeze molding machine, a sand stringer molding machine, a blow molding machine, a plunger press molding machine, a three-dimensional molding machine, and the like.

The method for filling the space of the permanent mold with the foamed composition is not particularly limited. A press-fitting method is usually applied. A temperature of the permanent mold to be used is not particularly limited. It is usually in a range from 100° C. to 400° C., and preferably from 200° C. to 300° C. Thereafter, when the foamed composition filled in the permanent mold is solidified, the temperature of the permanent mold may be kept constant or may be changed. When the sand mold is removed from the permanent mold after the foamed composition has solidified, the sand mold may be in either a heated state or a cooled state.

When the sand mold of the present invention is used together with a molten metal or alloy, a cast product having a desired shape can be easily produced.

EXAMPLES

Hereinafter, in order to make the configuration and effects of the present invention more specific, Examples and the like are indicated, but the present invention is not limited to these Examples. In the following Examples and Comparative Examples, "%" may mean "% by mass".

1. Test Section 1 (Production of Additive Composition (I) for Molding Sand Mold)

Raw materials for producing the additive composition (I) for molding a sand mold are shown below.

1-1. Component (A)

A-1: Mixture of sodium alkylsulfonates having an alkyl group with 14 to 18 carbon atoms (mixture of five compounds, that is, mixture of sodium tetradecylsulfonate having an alkyl group with 14 carbon atoms, sodium pentadecylsulfonate having an alkyl group with 15 carbon atoms, sodium hexadecylsulfonate having an alkyl group with 16 carbon atoms, sodium heptadecylsulfonate having an alkyl group with 17 carbon atoms, and sodium octadecylsulfonate having an alkyl group with 18 carbon atoms. The same applies to the following.)

A-2: Mixture of sodium alkylsulfonates having an alkyl group with 9 to 13 carbon atoms (mixture of five compounds)

A-3: Mixture of potassium alkylsulfonates having an alkyl group with 19 to 22 carbon atoms (mixture of four compounds)

A-4: Mixture of lithium alkylsulfonates having an alkyl group with 19 to 22 carbon atoms (mixture of four compounds)

A-5: Mixture of sodium alkylsulfonates having an alkyl group having 19 to 22 carbon atoms (mixture of four compounds)

1-2. Component (B)

B-1: Mixture of sodium alkyl sulfates having an alkyl group with 8 to 10 carbon atoms (mixture of three compounds)

B-2: Mixture of sodium alkyl sulfates having an alkyl group having 10 to 14 carbon atoms (mixture of five compounds)

B-3: Mixture of sodium alkyl sulfates having an alkyl group with 14 to 18 carbon atoms (mixture of five compounds)

1-3. Component (C)

C-1: Mixture of sodium polyoxyalkylene alkyl ether sulfate (3 to 4 mol of ethylene oxide added) having an alkyl group with 12 to 14 carbon atoms (mixture of three compounds)

C-2: Mixture of sodium polyoxyalkylene alkyl ether sulfate (3 to 4 mol of ethylene oxide added) having an alkyl group with 10 to 12 carbon atoms (mixture of three compounds)

C-3: Mixture of potassium polyoxyalkylene alkyl ether sulfate (2 to 5 mol of ethylene oxide added) having an alkyl group with 12 to 16 carbon atoms (mixture of five compounds)

C-4: Mixture of lithium polyoxyalkylene alkyl ether sulfate (2 to 5 mol of ethylene oxide added) having an alkyl group with 12 to 16 carbon atoms (mixture of five compounds)

1-4. Component (D)

D-1: Mixture of sodium linear alkylbenzene sulfonates having an alkyl group with 10 to 16 carbon atoms (mixture of seven compounds)

1-5. Other Components a-1: Dodecyl ether phosphate potassium (5 mol of ethylene oxide added)

Subsequently, examples of preparing an additive composition for molding a sand mold using the above raw materials will be described.

Example 1-1

Using the alkylsulfonate metal salt A-1, the alkyl sulfate metal salt B-1, and the polyoxyalkylene alkyl ether sulfate metal salt C-1 in proportions shown in Table 1, these components were uniformly mixed to prepare an additive composition H-1 for molding a sand mold.

Examples 1-2 to 1-12 and Comparative Examples 1-1 to 1-3

Using the components shown in Table 1 in predetermined proportions, H-2 to H-12 and h-1 to h-3 were prepared in the same manner as in Example 1-1.

TABLE 1

| | Additive composition (I) for molding sand mold | | | | | | | | | | |
|---|---|---|---|---|---|---|---|---|---|---|---|
| | | Raw material | | | | | | | | | |
| | | Component (A) | | Component (B) | | Component (C) | | Component (D) | | Other components | |
| | Type | Type | % by mass | Type | % by mass | Type | % by mass | Type | % by mass | Type | % by mass |
| Example 1-1 | H-1 | A-1 | 92.4 | B-1 | 3.8 | C-1 | 3.8 | | | | |
| Example 1-2 | H-2 | A-1 | 96.0 | B-1 | 2.0 | C-1 | 2.0 | | | | |
| Example 1-3 | H-3 | A-2 | 92.4 | B-2 | 3.8 | C-2 | 3.8 | | | | |
| Example 1-4 | H-4 | A-1 | 80.0 | B-1 | 10.0 | C-1 | 10.0 | | | | |
| Example 1-5 | H-5 | A-1 | 92.3 | | | C-1 | 7.7 | | | | |
| Example 1-6 | H-6 | A-1 | 92.3 | B-1 | 7.7 | | | | | | |
| Example 1-7 | H-7 | A-1 | 90.0 | B-3 | 10.0 | | | | | | |
| Example 1-8 | H-8 | A-2 | 92.4 | | | C-3 | 3.8 | D-1 | 3.8 | | |
| Example 1-9 | H-9 | A-3 | 96.0 | | | C-4 | 4.0 | | | | |
| Example 1-10 | H-10 | A-4 | 96.0 | | | | | D-1 | 4.0 | | |
| Example 1-11 | H-11 | A-1 | 100.0 | | | | | | | | |
| Example 1-12 | H-12 | A-5 | 100.0 | | | | | | | | |
| Comparative Example 1-1 | h-1 | | | | | C-1 | 100.0 | | | | |
| Comparative Example 1-2 | h-2 | | | B-1 | 50.0 | C-1 | 50.0 | | | | |
| Comparative Example 1-3 | h-3 | | | B-1 | 3.8 | C-1 | 3.8 | | | a-1 | 92.4 |

2. Test Section 2 (Production of Additive Composition (II) for Molding Sand Mold Containing Binder and Evaluation of Stability Thereof)

Examples 2-1 to 2-12 and Comparative Examples 2-1 to 2-3

100 parts by mass of sodium silicate, 8 parts by mass of the additive composition (I) for molding a sand mold obtained in Test Section 1, and 240 parts by mass of water were put in a beaker, and these components were stirred and mixed by a stirrer to prepare additive compositions J-1 to J-12 and j-1 to j-3 for molding a sand mold shown in Table 2. Next, a state of these additive compositions (II) for molding a sand mold after being left to stand at 20° C. for 24 hours was visually observed, and stability of the additive compositions (II) for molding a sand mold was evaluated according to the following criteria. The results are summarized in Table 2.

Criteria for Determining Stability

1: Neither precipitation nor separation occurred.

2: Slight precipitation occurred but the resultant precipitate was redispersed by stirring.

3: Separation and precipitation occurred, but the resultant precipitate was impossible to be redispersed by stirring.

TABLE 2

| | Additive composition (II) for molding sand mold | | | | | |
|---|---|---|---|---|---|---|
| | | Raw material | | | | |
| | | Additive composition (I) for molding sand mold | | Sodium silicate | Water | Evaluation |
| | Type | Type | parts by mass | parts by mass | parts by mass | Stability |
| Example 2-1 | J-1 | H-1 | 8 | 100 | 240 | 1 |
| Example 2-2 | J-2 | H-2 | 8 | 100 | 240 | 1 |
| Example 2-3 | J-3 | H-3 | 8 | 100 | 240 | 1 |
| Example 2-4 | J-4 | H-4 | 8 | 100 | 240 | 1 |
| Example 2-5 | J-5 | H-5 | 8 | 100 | 240 | 2 |
| Example 2-6 | J-6 | H-6 | 8 | 100 | 240 | 2 |
| Example 2-7 | J-7 | H-7 | 8 | 100 | 240 | 2 |
| Example 2-8 | J-8 | H-8 | 8 | 100 | 240 | 2 |
| Example 2-9 | J-9 | II-9 | 8 | 100 | 240 | 2 |
| Example 2-10 | J-10 | H-10 | 8 | 100 | 240 | 2 |
| Example 2-11 | J-11 | H-11 | 8 | 100 | 240 | 1 |
| Example 2-12 | J-12 | H-12 | 8 | 100 | 240 | 2 |
| Comparative Example 2-1 | j-1 | h-1 | 8 | 100 | 240 | 3 |
| Comparative Example 2-2 | j-2 | h-2 | 8 | 100 | 240 | 3 |
| Comparative Example 2-3 | j-3 | h-3 | 8 | 100 | 240 | 3 |

From Table 2, it can be seen that Examples 2-1 to 2-12 are examples of the additive composition for molding a sand mold according to the present invention, and these water-dispersible compositions are excellent in stability.

3. Test Section 3 (Preparation of Foamed Sand Composition for Molding Sand Mold and Evaluation of Productivity Thereof)

Examples 3-1 to 3-12 and Comparative Examples 3-1 to 3-3

Foamed-state sand compositions for molding a sand mold (hereinafter, also referred to as "foamed composition") were each prepared using the additive composition (I) for molding a sand mold obtained in Test Section 1, a binder of the following item 3-1, sand of the following item 3-2, and water in proportions shown in Table 3 by four preparation procedures of the following item 3-3. Since productivity of the foamed composition used in the production of a sand mold affects productivity of the sand mold, viscosity of the foamed compositions was measured by a method of the following item 3-4, and the productivity of the obtained foamed compositions was evaluated according to criteria of the following item 3-5 (see Table 4).

3-1. Binder

Sodium silicate was used.

3-2. Sand

S-1: Artificial sand "Green Beads AFS; 90" (trade name) manufactured by KINSEI MATEC CO., LTD.

S-2: Artificial sand "Espearl #60L" (trade name) manufactured by Yamakawa Sangyo Co., Ltd.

3-3. Preparation Procedures (1) Preparation Procedure 1

The additive composition (I) for molding a sand mold obtained in Test Section 1, a binder, sand, and water were used in the proportions shown in Table 3, and a total of 2,000 grams of these components were stirred and mixed with a tabletop mixer until a foamed state was achieved, thereby obtaining foamed compositions including sand compositions N-1 to N-12 and n-1 to n-3 for molding a sand mold.

(2) Preparation Procedure 2

The additive composition (I) for molding a sand mold obtained in Test Section 1, a binder, and water were put, in a 500 ml beaker, in the proportions shown in Table 3. These components were stirred and mixed by a stirrer, and the mixture was transferred to a closed container and left to stand at 20° C. for 1 week. Thereafter, a total amount of 2,000 grams of the above mixture and sand in the amounts shown in Table 3 were stirred and mixed with a tabletop mixer until a foamed state was achieved, thereby obtaining foamed compositions including the sand compositions N-1 to N-12 and n-1 to n-3 for molding a sand mold.

(3) Preparation Procedure 3

The additive composition (I) for molding a sand mold obtained in Test Section 1, a binder, and water were put, in a 500 ml beaker, in the proportions shown in Table 3. These components were stirred and mixed by a stirrer, and the mixture was transferred to a closed container and left to stand at 20° C. for 1 week. Thereafter, the mixture was foamed using a pump former bottle manufactured by Honda

TABLE 3

| | Sand composition for molding sand mold | | | | | | |
|---|---|---|---|---|---|---|---|
| | | Raw material | | | | | |
| | | Additive composition (I) for molding sand mold | | Sodium silicate | Water | Sand | |
| | Type | Type | parts by mass | parts by mass | parts by mass | Type | parts by mass |
| Example 3-1 | N-1 | H-1 | 0.060 | 0.75 | 1.84 | S-1 | 100 |
| Example 3-2 | N-2 | H-2 | 0.060 | 0.75 | 1.84 | S-1 | 100 |
| Example 3-3 | N-3 | H-3 | 0.500 | 0.75 | 1.60 | S-2 | 100 |
| Example 3-4 | N-4 | H-4 | 0.010 | 0.75 | 2.10 | S-2 | 100 |
| Example 3-5 | N-5 | H-5 | 0.060 | 0.75 | 1.84 | S-1 | 100 |
| Example 3-6 | N-6 | H-6 | 0.060 | 0.75 | 1.84 | S-1 | 100 |
| Example 3-7 | N-7 | H-7 | 0.060 | 0.75 | 1.84 | S-1 | 100 |
| Example 3-8 | N-8 | H-8 | 0.060 | 0.75 | 1.84 | S-1 | 100 |
| Example 3-9 | N-9 | II-9 | 0.060 | 0.75 | 1.84 | S-1 | 100 |
| Example 3-10 | N-10 | H-10 | 0.060 | 0.75 | 1.84 | S-1 | 100 |
| Example 3-11 | N-11 | H-11 | 0.060 | 0.75 | 1.84 | S-1 | 100 |
| Example 3-12 | N-12 | H-12 | 0.060 | 0.75 | 1.84 | S-1 | 100 |
| Comparative Example 3-1 | n-1 | h-1 | 0.015 | 0.75 | 3.08 | S-1 | 100 |
| Comparative Example 3-2 | n-2 | h-2 | 0.060 | 0.75 | 1.84 | S-1 | 100 |
| Comparative Example 3-3 | n-3 | h-3 | 0.060 | 0.75 | 1.84 | S-1 | 100 |

Plus Co., Ltd. A total amount of 2,000 grams of the foamed material and sand in the amounts shown in Table 3 were stirred and mixed with a tabletop mixer until a foamed state was achieved, thereby obtaining foamed compositions including the sand compositions N-1 to N-12 and n-1 to n-3 for molding a sand mold.

(4) Preparation Procedure 4

The additive composition (I) for molding a sand mold obtained in Test Section 1, a binder, sand, and water were used in the proportions shown in Table 3, and a total of 2,000 grams of these components were stirred and mixed with a tabletop mixer until a foamed state was achieved. These compositions were then transferred to separate sealed containers and left to stand at 20° C. for 1 week. Thereafter, these compositions were put into the tabletop mixer again, and stirred and mixed until a foamed state was achieved to obtain foamed compositions including the sand compositions N-1 to N-12 and n-1 to n-3 for molding a sand mold.

3-4. Measurement of Viscosity of Foamed-State Sand Composition for Molding Sand Mold Viscosity of the foamed-state sand compositions for molding a sand mold (foamed compositions) was measured using a measuring jig manufactured by our company as a viscosity measuring device.

First, the foamed compositions were each put into a cylindrical container with an inner diameter of 42 mm having pores with a diameter of 6 mm at the bottom, and pressurized with a self-weight of a cylindrical weight having a weight of 1 kg and a diameter of 40 mm to discharge the foamed composition from the pores. At this time, time required for the weight to move 50 mm was measured, and the viscosity μ (Pa·s) was calculated by the following formula. The temperature at the time of viscosity measurement was 25° C.

$$\mu=\pi D^4 P_p t/(128 L_1 L_2 S)$$

(in the equation, D is a diameter of the bottom pores (m), $P_p$ is a force applied by the weight (Pa), t is time (s) required for the weight to move 50 mm, $L_1$ is a distance of movement of the weight (=50 mm), $L_2$ is a plate thickness (m) of the bottom pores, and S is an average ($m^2$) of areas of the cylindrical weight and the cylinder)

3-5. Evaluation of Productivity of Foamed-State Sand Composition for Molding Sand Mold The viscosity μ of the foamed-state sand compositions for molding a sand mold (foamed composition) was measured every 30 seconds after the start of mixing of all the raw materials, and a preparation time until the viscosity μ reached 10 Pa·s or less was determined to evaluate the productivity of the foamed compositions according to the following criteria. In Preparation Procedures 1 to 3, a time from the start of mixing with the tabletop mixer until the viscosity reached 10 Pa·s or less was measured as "stirring/mixing time", and, in Preparation Procedure 4, the time from the start of mixing with the tabletop mixer until the viscosity reached 10 Pa·s or less was measured again after the compositions were left to stand for 1 week as "stirring/mixing time".

Criteria for Determining Productivity

1: The stirring/mixing time during which the viscosity reached 10 Pa·s or less was less than 60 seconds.

2: The stirring/mixing time during which the viscosity reached 10 Pa·s or less was 60 seconds or more and less than 120 seconds.

3: The stirring/mixing time during which the viscosity reached 10 Pa·s or less was 120 seconds or more and less than 180 seconds.

4: The stirring/mixing time during which the viscosity reached 10 Pa·s or less was 180 seconds or more and less than 300 seconds.

5: The stirring/mixing time during which the viscosity reached 10 Pa·s or less exceeded 300 seconds.

TABLE 4

| | Sand composition for molding sand mold | Evaluation | | | |
|---|---|---|---|---|---|
| | | Evaluation procedure 1 | Evaluation procedure 2 | Evaluation procedure 3 | Evaluation procedure 4 |
| Example 3-1 | N-1 | 3 | 3 | 2 | 1 |
| Example 3-2 | N-2 | 3 | 3 | 2 | 1 |
| Example 3-3 | N-3 | 3 | 3 | 2 | 1 |
| Example 3-4 | N-4 | 3 | 3 | 2 | 2 |
| Example 3-5 | N-5 | 3 | 3 | 2 | 2 |
| Example 3-6 | N-6 | 3 | 3 | 2 | 2 |
| Example 3-7 | N-7 | 3 | 3 | 2 | 2 |
| Example 3-8 | N-8 | 3 | 3 | 2 | 2 |
| Example 3-9 | N-9 | 3 | 4 | 3 | 3 |
| Example 3-10 | N-10 | 3 | 4 | 4 | 3 |
| Example 3-11 | N-11 | 3 | 4 | 4 | 4 |
| Example 3-12 | N-12 | 3 | 4 | 4 | 4 |
| Comparative Example 3-1 | n-1 | 4 | 5 | 5 | 5 |
| Comparative Example 3-2 | n-2 | 4 | 4 | 5 | 4 |
| Comparative Example 3-3 | n-3 | 4 | 5 | 5 | 4 |

From Table 4, it can be seen that Examples 3-1 to 3-12 are examples of the sand composition for molding a sand mold according to the present invention, which not only were excellent in stability as a one-component material, but also could shorten the production time for a composition suitable for producing a sand mold by using the one-component material in a foamed state. In addition, it has been found that, even after the prepared sand compositions for molding a sand mold were left to stand, suitable compositions can be obtained by re-stirring the sand compositions.

4. Test Section 4 (Evaluation of Productivity of Sand Mold)

Examples 4-1 to 4-12 and Comparative Examples 4-1 to 4-3

The following experiments (X) and (Y) were performed using the foamed-state sand compositions for molding a sand mold (which were foamed until the viscosity reached 10 Pa·s or less) obtained in Preparation Procedure 1 of Test Section 3, and productivity of sand molds was evaluated.

(X) Filling Performance of Sand Composition for Molding Sand Mold

The foamed-state sand compositions for molding a sand mold (foamed compositions) were each filled in a space for forming a test piece (size: 30 mm×30 mm×150 mm) in a permanent mold heated to 250° C., and fired until the foamed composition solidified to prepare a test piece, and a mass of the test piece was measured.

From the mass of the test piece, the filling performance of the foamed composition was evaluated according to the following criteria. The results are shown in Table 5.

Criteria for Determining Filling Performance of Foamed Composition

1: The mass of the test piece was 225 g or more and less than 227 g.

2: The mass of the test piece was 220 g or more and less than 225 g or 227 g or more and less than 235 g.

3: The mass of the test piece was 235 g or more.

4: The mass of the test piece was 210 g or more and less than 220 g.

5: The mass of the test piece was less than 210 g.

(Y) Production Time for Sand Mold

The foamed-state sand compositions for molding a sand mold (foamed compositions) were each filled in a space for forming a mold (inner volume: about 250 $cm^3$) in a permanent mold heated to 250° C., and the time until the foamed composition solidified (production time) was measured. The results based on the following criteria are shown in Table 5.

Production Time for Sand Mold

1: The production time was shortened by more than 10% as compared with Comparative Example 4-1.

2: The production time was reduced by 5% to 10% as compared with Comparative Example 4-1.

3: Production time was about the same as that in Comparative Example 4-1

TABLE 5

| | Sand composition for molding sand mold | Evaluation | |
|---|---|---|---|
| | | (X) Filling performance of foamed composition | (Y) Production time for sand mold |
| Example 4-1 | N-1 | 1 | 1 |
| Example 4-2 | N-2 | 1 | 1 |
| Example 4-3 | N-3 | 1 | 1 |
| Example 4-4 | N-4 | 2 | 1 |
| Example 4-5 | N-5 | 2 | 1 |

TABLE 5-continued

| | Sand composition for molding sand mold | Evaluation | |
|---|---|---|---|
| | | (X) Filling performance of foamed composition | (Y) Production time for sand mold |
| Example 4-6 | N-6 | 2 | 1 |
| Example 4-7 | N-7 | 2 | 2 |
| Example 4-8 | N-8 | 2 | 2 |
| Example 4-9 | N-9 | 3 | 2 |
| Example 4-10 | N-10 | 3 | 2 |
| Example 4-11 | N-11 | 4 | 2 |
| Example 4-12 | N-12 | 4 | 2 |
| Comparative Example 4-1 | n-1 | 5 | 3 |
| Comparative Example 4-2 | n-2 | 5 | 3 |
| Comparative Example 4-3 | n-3 | 5 | 3 |

From Table 5, it can be seen that Examples 4-1 to 4-12 are examples using the sand composition for molding a sand mold of the present invention, and the production time for a sand mold could be shortened as compared with Comparative Examples 4-1 to 4-3. In particular, in Examples 4-1 to 4-3, the filling performance of the sand compositions for molding a sand mold into the permanent mold was excellent, and the productivity of sand molds was excellent.

5. Test Section 5

The productivity of sand molds was evaluated in the same manner as in Test Section 4 for the foamed-state sand compositions for molding a sand mold (which were foamed until the viscosity reached 10 Pa·s or less) obtained in Preparation Procedures 2 to 4 of Test Section 3. As a result, the same results as in Test Section 4 were obtained in all the sand molds obtained using the sand compositions for molding a sand mold (foamed compositions) in Preparation Procedures 2 to 4.

INDUSTRIAL APPLICABILITY

The additive composition for molding a sand mold according to the present invention is suitably blended in a sand composition for molding a sand mold to be foamed and used in molding a sand mold. The use of the sand composition for molding a sand mold makes it possible to shorten the production time for a sand mold, so that various kinds of sand molds can be efficiently produced. In particular, it is suitable for casting a metal or an alloy.

The invention claimed is:

1. An additive composition for a foamed sand, the additive composition comprising:

(A) an alkylsulfonate metal salt having an alkyl group with 9 to 22 carbon atoms and at least one component selected from a group consisting of: (B) an alkylsulfate metal salt; (C) a polyoxyalkylene alkyl ether sulfate metal salt; and (D) an alkylbenzene sulfonate metal salt.

2. The additive composition for a foamed sand of claim 1, wherein the additive composition comprises at least one component of the alkylsulfate metal salt (B) and the polyoxyalkylene alkyl ether sulfate metal salt (C).

3. The additive composition for a foamed sand of claim 1, wherein the alkylsulfate metal salt (B) comprises an alkylsulfate metal salt having an alkyl group with 8 to 18 carbon atoms.

4. The additive composition for a foamed sand of claim 1, wherein the polyoxyalkylene alkyl ether sulfate metal salt (C) comprises a polyoxyalkylene alkyl ether sulfate metal salt having an alkyl group with 10 to 16 carbon atoms.

5. The additive composition for a foamed sand of claim 1, wherein a content ratio of the alkylsulfonate metal salt (A) is in a range from 80% to 96% by mass based on a total mass of additive composition for a foamed sand.

6. The additive composition for a foamed sand of claim 1, wherein the additive composition comprises the alkylsulfate metal salt (B) and the polyoxyalkylene alkyl ether sulfate metal salt (C), and wherein content ratios of the alkylsulfonate metal salt (A), the alkylsulfate metal salt (B) and the alkyl ether sulfate metal salt (C) are respectively 80% to 96% by mass, 2% to 10% by mass, and 2% to 10% by mass, based on a total mass of these components.

7. A sand composition for molding a sand mold, comprising:

the additive composition for a foamed sand of claim 1; and a sand.

8. A method for producing a sand mold, the method comprising molding the sand composition for molding a sand mold of claim 7.

9. The method for producing a sand mold of claim 8, further comprising:

stirring the sand composition for molding a sand mold to form a foamed sand;

filling a space for forming a mold with the obtained foamed sand; and solidifying a filling material in the space for forming a mold.

10. The method for producing a sand mold of claim 8, further comprising:

foaming the additive composition for a foamed sand to prepare a foamy material, and stirring the foamy material and the sand to form the foamed sand for molding a sand mold;

filling a space for forming a mold with the obtained foamed sand; and solidifying a filling material in the space for forming a mold.

11. A sand mold, comprising:

the additive composition for a foamed sand of claim 1; and a sand.

* * * * *